US010242777B2

(12) United States Patent
Iwasaki et al.

(10) Patent No.: US 10,242,777 B2
(45) Date of Patent: Mar. 26, 2019

(54) ALLOY FOR R-T-B BASED SINTERED MAGNET AND R-T-B BASED SINTERED MAGNET

(71) Applicant: TDK Corporation, Tokyo (JP)

(72) Inventors: Makoto Iwasaki, Tokyo (JP); Tetsuya Hidaka, Tokyo (JP); Takuma Hayakawa, Tokyo (JP); Ayato Kakoki, Tokyo (JP); Yoshinori Fujikawa, Tokyo (JP); Syota Goto, Tokyo (JP); Haruna Nakajima, Tokyo (JP); Takeshi Masuda, Tokyo (JP); Chikara Ishizaka, Tokyo (JP)

(73) Assignee: TDK Corporation, Tokyo (JP)

( * ) Notice: Subject to any disclaimer, the term of this patent is extended or adjusted under 35 U.S.C. 154(b) by 87 days.

(21) Appl. No.: 15/420,151

(22) Filed: Jan. 31, 2017

(65) Prior Publication Data

US 2017/0221616 A1 Aug. 3, 2017

(30) Foreign Application Priority Data

Feb. 1, 2016 (JP) ..... 2016-017200

(51) Int. Cl.
*H01F 1/055* (2006.01)
*B22F 1/00* (2006.01)
(Continued)

(52) U.S. Cl.
CPC ..... *H01F 1/0557* (2013.01); *B22F 1/0059* (2013.01); *B22F 3/1017* (2013.01);
(Continued)

(58) Field of Classification Search
None
See application file for complete search history.

(56) References Cited

U.S. PATENT DOCUMENTS 9,257,227 B2 * 2/2016 Haga ..... H01F 41/005
10,109,403 B2 * 10/2018 Kanada ..... C22C 38/00
(Continued)

FOREIGN PATENT DOCUMENTS

CN 103890868 6/2014
JP 07283016 A * 10/1995 ..... H01F 1/057
(Continued)

OTHER PUBLICATIONS

Katter, M., Zapf, L., Blank, R., Fernengel, W., and Rodewald, W., IEEE Trans. Mag., v37(4), 2001, pp. 2474-2476. (Year: 2001).*
(Continued)

*Primary Examiner* — Kevin M Bernatz
(74) *Attorney, Agent, or Firm* — Drinker Biddle & Reath LLP

(57) ABSTRACT

Provided is a sintered magnet that is an R-T-B based sintered magnet having a region having a concentration of at least one heavy rare earth element decreasing from the surface toward the inside, in which the at least one heavy rare earth element includes at least either of Tb or Dy, R includes Nd, T includes Fe, Co, and Cu, there is a grain boundary phase containing at least either of Tb or Dy and Nd between two main phase particles, and a value obtained by subtracting a half value width of a concentration distribution curve of Cu from a half value width of a concentration distribution curve of Tb or Dy in a part including the grain boundary phase is from 10 to 20 nm.

1 Claim, 10 Drawing Sheets

(51) Int. Cl.

| | |
|---|---|
| ***B22F 3/10*** | (2006.01) |
| ***B22F 9/02*** | (2006.01) |
| ***C22C 38/00*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |
| ***H01F 1/057*** | (2006.01) |
| ***H01F 41/02*** | (2006.01) |
| *B22F 9/04* | (2006.01) |
| *C22C 33/02* | (2006.01) |

(52) U.S. Cl.

CPC ..... *B22F 9/026* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *H01F 1/0577* (2013.01); *H01F 41/0293* (2013.01); *B22F 2009/044* (2013.01); *B22F 2202/05* (2013.01); *B22F 2301/35* (2013.01); *B22F 2998/10* (2013.01); *B22F 2999/00* (2013.01); *C22C 33/02* (2013.01); *C22C 2202/02* (2013.01)

(56) References Cited

U.S. PATENT DOCUMENTS 10,115,506 B2 * 10/2018 Hu ..... H01F 1/0577
2010/0282371 A1 * 11/2010 Sagawa ..... H01F 1/0557 148/302
2011/0234348 A1 * 9/2011 Miwa ..... C22C 38/002 335/302
2012/0024429 A1 * 2/2012 Hayakawa ..... H01F 1/0577 148/302
2013/0068992 A1 * 3/2013 Hono ..... C21D 6/00 252/62.55
2013/0092868 A1 * 4/2013 Nakajima ..... C22C 38/005 252/62.51 R
2014/0283649 A1 9/2014 Kunieda et al.
2016/0163434 A1 * 6/2016 Kanada ..... C22C 38/00 310/156.08
2016/0163435 A1 * 6/2016 Miwa ..... H01F 1/0577 335/302
2016/0180993 A1 * 6/2016 Kanada ..... C22C 38/00 252/62.55
2016/0196904 A1 * 7/2016 Kanada ..... C22C 38/00 420/83

FOREIGN PATENT DOCUMENTS

JP 2009-170541 A 7/2009
JP 2011210823 A * 10/2011

OTHER PUBLICATIONS

JPO Abstract and Machine Translation of JP 07-283016 A. (Year: 1995).*
JPO Abstract and Machine Translation of JP 2011-210823 A. (Year: 2011).*
Derwent Abstract of WO 2015020180 A1 (Year: 2015).*
Derwent Abstract Translation of WO 2015/020181 A1 (Year: 2015).*

* cited by examiner

ALLOY FOR R-T-B BASED SINTERED MAGNET AND R-T-B BASED SINTERED MAGNET

TECHNICAL FIELD

The present invention relates to an alloy for R-T-B based sintered magnet and an R-T-B based sintered magnet.

BACKGROUND

An R-T-B based sintered magnet containing a rare earth element R, a transition metal element T such as Fe or Co, and boron B exhibits excellent magnetic properties. Hitherto, a number of investigations have been carried out in order to improve the residual magnetic flux density (Br) and coercive force (HcJ) of an R-T-B based sintered magnet. For example, it is known that the coercive force and the rectangularity in the magnetization curve are improved by setting the amount of the rare earth element in a metal state contained in the magnet base material to a predetermined amount or more (Patent Literature 1).

CITATION LIST

Patent Literature

[Patent Literature 1] Japanese Unexamined Patent Publication No. JP2009-170541

SUMMARY

However, a sintered magnet to be used in a high performance motor and the like is required to exhibit further improved magnetic properties. The Nd—Fe—B sintered magnet obtained by the production method of Patent Literature 1 also has room for improvement of rectangularity in the magnetization curve.

The present invention has been achieved in view of the above-mentioned problems of the prior art, and an object thereof is to provide an R-T-B based sintered magnet exhibiting improved rectangularity and an alloy for R-T-B based sintered magnet suitable for producing the same.

The alloy for R-T-B based sintered magnet of the present invention is an R-T-B based alloy, in which R includes Nd, T includes Fe, Co, and Cu, a region A having an element concentration of Cu of 0.5 at % or more is present in an R-rich phase in one cross section of the alloy, and an area of the region A is 80% or more with respect to an area of the R-rich phase.

In the alloy, it is preferable that a region B having an element concentration of Co of 2.5 at % or more is present in the region A and an area of the region B is 60% or more with respect to an area of the R-rich phase.

In the R-T-B based sintered magnet of the present invention, R includes Nd, T includes Fe, Co, and Cu, and a maximum element concentration of Cu in a grain boundary phase between two main phase particles of the sintered magnet is from 1 to 5 at %.

In the R-T-B based sintered magnet of the present invention, there is a region in which a concentration of at least one heavy rare earth element decreases from the surface toward the inside, the at least one heavy rare earth element includes at least either of Tb or Dy, R includes Nd, T includes Fe, Co, and Cu, there is a grain boundary phase containing at least either of Tb or Dy and Nd between two main phase particles, and a value obtained by subtracting a half value width of a concentration distribution curve of Cu from a half value width of a concentration distribution curve of Tb or Dy in a part including the grain boundary phase is from 10 to 20 nm.

According to the present invention, it is possible to provide an R-T-B based sintered magnet exhibiting improved rectangularity and an alloy for R-T-B based sintered magnet suitable for producing the same.

DETAILED DESCRIPTION

Figure 1A:
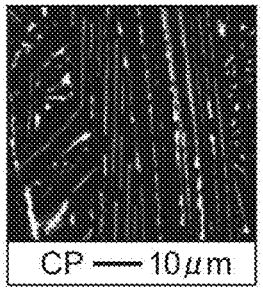
FIGS. 1A to 1D illustrate elemental analysis results of an alloy 1 by EPMA.

<Alloy for R-T-B Based Sintered Magnet >

The alloy for R-T-B based sintered magnet of the present embodiment is an R-T-B based alloy containing a rare earth element R, a transition metal element T, and boron B. R includes Nd and T includes Fe, Co, and Cu. Incidentally, the alloy for R-T-B based sintered magnet is also simply referred to as the alloy for magnet in the following description.

The rare earth element R may include at least one kind of rare earth element selected from the group consisting of Sc, Y, La, Ce, Pr, Pm, Sm, Eu, Gd, Tb, Dy, Ho, Er, Tm, Yb and Lu other than Nd. Pr or Dy and Tb are preferable as the rare-earth elements other than Nd.

In the alloy for magnet of the present embodiment, the content of R is preferably from 29 to 33 mass % and more preferably from 29.5 to 31.5 mass % with respect to the total mass of the alloy. A sintered magnet having a high coercive force is likely to be obtained when a sintered magnet is produced from the alloy for magnet when the content of R is 29 mass % or more. Meanwhile, an R-rich nonmagnetic phase does not increase too many in the sintered magnet produced from the alloy for magnet and the residual magnetic flux density of the sintered magnet tends to be improved when the content of R is 33 mass % or less.

In the alloy for magnet of the present embodiment, the content of Nd is preferably from 15 to 33 mass % and more preferably from 20 to 31.5 mass % with respect to the total mass of the alloy. The coercive force and the residual magnetic flux density tend to be improved when the content of Nd in the alloy for magnet is from 15 to 33 mass %. In addition, the content of element Pr in the alloy for magnet of the present embodiment is preferably from 5 to 10 mass % from the viewpoint of cost. The alloy for magnet may contain Dy or Tb according to the required coercive force. The content of Dy or Tb is preferably from 0 to 10 mass % with respect to the total mass of the alloy.

The alloy for magnet of the present embodiment may contain elements other than Nd, Fe, Co, and Cu, and it may contain Al, Si, Mn, Ni, Ga, Sn, Bi, Ti, V, Cr, Zr, Nb, Mo, Hf, Ta, and W. In particular, it is preferable to contain Al, Zr, or Ga. The content of Al in the alloy for magnet of the present embodiment is preferably from 0.05 to 0.3 mass % and even more preferably from 0.15 to 0.25 mass % with respect to the total mass of the alloy. The coercive force and residual magnetic flux density of the sintered magnet produced from the alloy for magnet tend to be improved when the content of Al in the alloy for magnet is from 0.05 to 0.3 mass %. The content of Zr in the alloy for magnet of the present embodiment is preferably from 0.05 to 0.3 mass % and even more preferably from 0.1 to 0.2 mass % with respect to the total mass of the alloy. The coercive force and residual magnetic flux density of the sintered magnet produced from the alloy for magnet tend to be improved when the content of Zr in the alloy for magnet is from 0.05 to 0.3 mass %. The content of Ga in the alloy for magnet of the present embodiment is preferably from 0.05 to 0.3 mass % and even more preferably from 0.1 to 0.2 mass % with respect to the total mass of the alloy. The coercive force and residual magnetic flux density of the sintered magnet produced from the alloy for magnet tend to be improved when the content of Ga in the alloy for magnet is from 0.05 to 0.3 mass %.

The content of Co in the alloy for magnet is preferably from 0.5 to 3 mass % and more preferably from 1.0 to 2.5 mass %. The coercive force and residual magnetic flux density of the sintered magnet produced from the alloy for magnet tend to be improved when the content of Co is from 0.5 to 3 mass %. In addition, the temperature coefficient of the residual magnetic flux density and the corrosion resistance are favorable. In addition, the content of Cu in the alloy for magnet is preferably from 0.05 to 0.3 mass % and more preferably from 0.15 to 0.25 mass %. The coercive force and residual magnetic flux density of the sintered magnet produced from the alloy for magnet tend to be improved when the content of Cu is from 0.05 to 0.3 mass %. In addition, the corrosion resistance is favorable. Fe is the remainder other than the essential elements and arbitrary elements in the alloy for magnet of the present embodiment, and the content of Fe is preferably from 50 to 70 mass %.

The content of B in the alloy for magnet is preferably from 0.5 to 2 mass %, more preferably from 0.8 to 1.1 mass %, and even more preferably from 0.85 to 1.0 mass %. The coercive force of the sintered magnet produced from the alloy for magnet tends to be improved when the content of B is 0.5 mass % or more, and formation of a B-rich nonmagnetic phase in the sintered magnet produced from the alloy for magnet is suppressed and the residual magnetic flux density of the sintered magnet tends to be improved when the content of B is 2 mass % or less.

The alloy for magnet of the present embodiment mainly includes a dendritic main phase constituted by $R_2T_{14}B$ and an R-rich phase that is present in the grain boundary phase of the main phase and has a higher R concentration than the main phase particles. The concentration of R in the R-rich phase is, for example, 50 at % or more, and it may be 70 at % or more. In the alloy for magnet, a region A in which the element concentration of Cu is 0.5 at % or more is present in the R-rich phase in one cross section of the alloy, and the ratio (also referred to as the degree of coincidence of Nd—Cu) of the area of the region A to the area of the R-rich phase is 80% or more, and it is more preferably 90% or more.

In the alloy for magnet of the present embodiment, the region in which the R-rich phase is present and the region in which Cu is present overlap in a wide range as described above. It is possible to obtain a sintered magnet having a favorable residual magnetic flux density, a favorable coercive force, and favorable rectangularity even by calcination for a short time in the case of producing a sintered magnet before diffusion from such an alloy for magnet. In addition, it is possible to set the maximum element concentration of Cu between two main phase particles in the sintered magnet before diffusion to from 1 to 5 at % as to be described later. Although the reason for this is not necessarily clarified, the present inventors believe that this is because the dispersion state of Cu in the alloy affects the dispersion state thereof even after crushing and sintering. Alternatively, it is believed that the phase state in the sintering temperature region contains Cu at from 1 to 5 at % as Nd and Cu are present in the R-rich phase. In addition, it is possible to set the value obtained by subtracting the half value width of the concentration distribution curve of Cu from the half value width of the concentration distribution curve of Tb and Dy to be described later to from 10 to 20 nm in the case of producing a sintered magnet after diffusion to be described later from the alloy for magnet of the present embodiment. Hence, the sintered magnet after diffusion produced from the alloy for magnet of the present embodiment exhibits favorable rectangularity in the magnetization curve as to be described later.

In one cross section of the alloy for magnet, the maximum value of the element concentration of Cu in the main phase may be 0.1 at % or less, and it is preferable that Cu is not substantially contained in the main phase. In addition, the maximum value of the element concentration of Cu in the R-rich layer is preferably from 0.5 to 2 at %. It is easy to set the degree of coincidence of Nd—Cu to 80% or more when the maximum value of the element concentration of Cu in the R-rich layer is from 0.5 to 2 at %.

A region B in which the element concentration of Co is 2.5 at % or more may be present in the region A. The ratio (also referred to as the degree of coincidence of Nd—Cu—Co) of the area of the region B to the area of the R-rich phase is preferably 60% or more and even more preferably from 70 to 90%. When the degree of coincidence of Nd—Cu—Co is 60% or more, the melting point of the R-rich phase decreases so that the Cu distribution in the alloy or sintered magnet before diffusion is affected and the value obtained by subtracting the half value width of the concentration distribution curve of Cu from the half value width of the concentration distribution curve of Tb and Dy to be described later can be set to from 10 to 20 nm.

Here, the element concentrations of Nd, Cu, and Co in the cross section of the alloy for magnet can be measured by, for example, a three-dimensional atom probe (3DAP).

In addition to the main phase and the R-rich phase, the alloy for magnet includes an α-Fe phase or a chill crystal in some cases. The α-Fe phase is a phase that is mainly composed of Fe and generated in a case in which the cooling speed is slow at the time of casting the alloy, and the chill crystal is a granular crystal of 1 μm or less generated in a case in which cooling is fast. It is preferable that both the α-Fe phase and the chill crystal are 3% or less as the area ratio to the alloy cross section since the magnetic properties deteriorate.

Although the alloy for magnet has a dendrite texture, the texture state can be measured by measuring the interval between the R-rich phases. The average value of the R-rich phase interval is preferably from 2 to 5 μm and more preferably from 3 to 4 μm. It is preferable that the interval between the R-rich phases is from 3 to 4 μm since the residual magnetic flux density of the magnet produced is hardly obtained when the interval is fine and the coercive force is low when the interval is coarse.

<Sintered Magnet Before Diffusion>

The R-T-B based sintered magnet of the present embodiment contains Nd as the rare earth element R and Fe, Co, and Cu as the transition metal element T. Incidentally, the R-T-B sintered magnet into which a heavy rare earth element is not yet diffused is also referred to as the sintered magnet before diffusion in order to distinguish it from the R-T-B based sintered magnet into which a heavy rare earth element is diffused and which will be described later.

The rare earth element R may include at least one kind of rare earth element selected from the group consisting of Sc, Y, La, Ce, Pr, Pm, Sm, Eu, Gd, Tb, Dy, Ho, Er, Tm, Yb and Lu other than Nd. Pr or Dy and Tb are preferable as the rare earth element other than Nd.

In the sintered magnet before diffusion of the present embodiment, the content of R is preferably from 29 to 33 mass % and more preferably from 29.5 to 31.5 mass % with respect to the total mass of the sintered magnet before diffusion. A sintered magnet before diffusion having a high coercive force is likely to be obtained when the content of R is 29 mass % or more. Meanwhile, the R-rich nonmagnetic phase does not increase too many and the residual magnetic flux density of the sintered magnet before diffusion tends to be improved when the content of R is 33 mass % or less.

In the sintered magnet before diffusion of the present embodiment, the content of Nd is preferably from 15 to 33 mass % and even more preferably from 20 to 31.5 mass % with respect to the total mass of the sintered magnet before diffusion. The coercive force and the residual magnetic flux density tend to be improved when the content of Nd in the sintered magnet before diffusion is from 15 to 33 mass %. In addition, the content of element Pr in the sintered magnet before diffusion of the present embodiment is preferably from 5 to 10 mass % from the viewpoint of cost. The sintered magnet before diffusion may contain Dy or Tb according to the required coercive force. The content of Dy or Tb is preferably from 0 to 10 mass % with respect to the total mass of the sintered magnet before diffusion.

The sintered magnet before diffusion may contain elements other than Nd, Fe, Co, and Cu, and it may contain Al, Si, Mn, Ni, Ga, Sn, Bi, Ti, V, Cr, Zr, Nb, Mo, Hf, Ta, and W. In particular, it is preferable to contain Al, Zr, or Ga. The content of Al in the sintered magnet before diffusion of the present embodiment is preferably from 0.05 to 0.3 mass % and even more preferably from 0.15 to 0.25 mass % with respect to the total mass of the sintered magnet before diffusion. The coercive force and residual magnetic flux density of the sintered magnet before diffusion tend to be improved when the content of Al in the sintered magnet before diffusion is from 0.05 to 0.3 mass %. The content of Zr in the sintered magnet before diffusion of this embodiment is preferably from 0.05 to 0.3 mass % and even more preferably from 0.1 to 0.2 mass % with respect to the total mass of the sintered magnet before diffusion. The coercive force and residual magnetic flux density of the sintered magnet before diffusion tend to be improved when the content of Zr in the sintered magnet before diffusion is from 0.05 to 0.3 mass %. The content of Ga in the sintered magnet before diffusion of this embodiment is preferably from 0.05 to 0.3 mass % and even more preferably from 0.1 to 0.2 mass % with respect to the total mass of the sintered magnet before diffusion. The coercive force and residual magnetic flux density of the sintered magnet produced from the sintered magnet before diffusion tend to be improved when the content of Ga the sintered magnet before diffusion is from 0.05 to 0.3 mass %.

The content of Co in the sintered magnet before diffusion is preferably from 0.5 to 3 mass % and more preferably from 1.0 to 2.5 mass %. The coercive force and residual magnetic flux density of the sintered magnet before diffusion tend to be improved when the content of Co is from 0.5 to 3 mass %. In addition, the temperature coefficient of the residual magnetic flux density and the corrosion resistance are favorable. In addition, the content of Cu in the sintered magnet before diffusion is preferably from 0.05 to 0.3 mass % and more preferably from 0.15 to 0.25 mass %. The coercive force and residual magnetic flux density of the sintered magnet before diffusion tend to be improved and the corrosion resistance is also favorable when the content of Cu is from 0.15 to 0.25. Fe is the remainder other than the essential elements and arbitrary elements in the sintered magnet before diffusion of the present embodiment, and the content of Fe is preferably from 50 to 70 mass %.

The content of B in the sintered magnet before diffusion is preferably from 0.5 to 2 mass %, more preferably from 0.8 to 1.1 mass %, and even more preferably from 0.85 to 1.0 mass %. The coercive force of the sintered magnet before diffusion tends to be improved when the content of B is 0.5 mass % or more, and formation of a B-rich nonmagnetic phase in the sintered magnet before diffusion is suppressed and the residual magnetic flux density of the sintered magnet tends to be improved when the content of B is 2 mass % or less.

The sintered magnet before diffusion of the present embodiment is equipped with the main phase particles ($R_2T_{14}B$) and a grain boundary phase occupying the space among the main phase particles. In one cross section of the sintered magnet before diffusion of the present embodiment, the maximum element concentration of Cu between two main phase particles is from 1 to 5 at % and preferably from 2 to 4 at %. Here, the maximum element concentration of Cu is the maximum value of the element concentration of Cu between two main phase particles in the Cu element map of the cross section of the sintered magnet before diffusion obtained by, for example, EPMA, 3DAP, or the like. The sintered magnet before diffusion of the present embodiment exhibits favorable rectangularity since the maximum element concentration of Cu between two main phase particles is from 1 to 5 at %. Although the reason for this is not necessarily clarified, the present inventors believe that this is because the degree of exchange interaction between the grain boundary phases is appropriate and the magnetic coupling between the main phase particles is thus appropriate. In addition, it is easy to set the value obtained by subtracting the half value width of the concentration distribution curve of Cu from the half value width of the concentration distribution curve of Tb and Dy to be described later to from 10 to 20 nm in the case of producing a sintered magnet by diffusing Tb or Dy into such a sintered magnet before diffusion. Although the reason for this is not necessarily clarified, the present inventors believe that this is because the melting point of the grain boundary phase at the diffusion temperature decreases by the effect of Cu so that element Tb or Dy is likely to be diffused from the surface toward the inside of the magnet before diffusion and also the diffusion into the main phase particles is slower as compared to the diffusion into the grain boundary phase. Hence, the sintered magnet produced by diffusing Tb or Dy into such a sintered magnet before diffusion exhibits favorable rectangularity in the magnetization curve.

In the sintered magnet before diffusion of the present embodiment, the maximum value of the element concentration of Cu in the main phase particles is preferably 0.1 at % or less, and it is preferable that the main phase particles do not substantially contain Cu. Here, the term "do not substantially contain" means that the content of Cu in the main phase particles is less than the detection limit (0.01 at %) by EPMA, for example, in the case of conducting the elemental analysis of the cross section of the sintered magnet before diffusion by EPMA.

The average particle diameter of the main phase particles contained in the sintered magnet before diffusion is preferably from 1 to 5 μm and more preferably from 2.5 to 4 μm. The particles of a heavy rare earth element are likely to be uniformly attached to the surface of the sintered magnet before diffusion when a heavy rare earth element is diffused into the sintered magnet before diffusion when the particle diameter of the main phase particles is 5 μm or less. The particle diameter of the main phase particles can be controlled by the particle diameter of the alloy for magnet after grinding, the sintering temperature, the sintering time, and the like.

In the R-T-B based sintered magnet before diffusion of a heavy rare earth element of the prior art, element Cu is most present in a multiparticle grain boundary phase (grain boundary phase facing three or more main phase particles, for example, a grain boundary triple point facing three main phase particles is included.) among the grain boundary phases in the R-T-B based sintered magnet but it is not almost present in the grain boundary phase between two main phase particles. On the other hand, in the sintered magnet before diffusion of the present embodiment, there is a region in which a great amount of element Cu is present not only in the multiparticle grain boundary phase but also in the grain boundary phase between two main phase particles. Incidentally, in the present specification, the grain boundary phase between two main phase particles means a region in which the distance from the surface of one main phase particle to the surface of another adjacent main phase particle is 100 nm or less among the grain boundary phases, and it may be a region having the distance of 50 nm or less or a region having the distance of 30 nm or less. The lower limit value of the distance is not particularly limited, but it is about 10 nm.

<Sintered Magnet after Diffusion>

The R-T-B based sintered magnet of the present embodiment has a region in which the concentration of at least one heavy rare earth element decreases from the surface of the magnet toward the inside, and the at least one heavy rare earth element includes at least either of Tb or Dy, R includes Nd, and T includes Fe, Co, and Cu. The R-T-B based sintered magnet of the present embodiment is obtained by diffusing a heavy rare earth element including Tb or Dy into a sintered magnet before diffusion. Hence, in the following description, the R-T-B based sintered magnet into which a heavy rare earth element including Tb or Dy is diffused is also referred to as a sintered magnet after diffusion. Incidentally, the sintered magnet may have the same composition as the sintered magnet before diffusion except that it contains a heavy rare earth element introduced by diffusion. Incidentally, in the following description, the heavy rare earth element diffused into the sintered magnet after diffusion of the present embodiment is also referred to as the diffused heavy rare earth element.

The sintered magnet after diffusion of the present embodiment is one obtained by diffusing a heavy rare earth element from the surface of a magnet before diffusion as to be described later, and it thus has a region in which the concentration of the diffused heavy rare earth element decreases from the surface toward the inside. The surface (hereinafter, also referred to as the diffusion surface) in the sintered magnet after diffusion is derived from the surface on which a heavy rare earth compound is coated before diffusing the heavy rare earth element in the diffusion step to be described later. In the R-T-B based sintered magnet of the present embodiment, the diffusion surface may be the entire surface of the sintered magnet after diffusion or a part of the surface. More specifically, all six surfaces may be the diffusion surface, only two opposing surfaces may be the diffusion surface, or only one surface may be the diffusion surface in the case of a rectangular sintered magnet after diffusion. On the surface on which the diffusion surface is formed, the diffusion surface may be the entire surface, or the diffusion surface may be provided at one place of the surface or discretely provided at a plurality of places thereof. A sintered magnet after diffusion in which all of the six surfaces of the rectangular parallelepiped are the diffusion surface is preferable since the improvement range of the coercive force at the corner portion can be increased. In addition, one in which the diffusion surface is formed on a part of the surface is preferable since the amount of heavy rare earth element used is small and the residual magnetic flux density and the coercive force are closely uniform throughout the magnet.

In addition, the region in which the concentration of the diffused heavy rare earth element decreases in the sintered magnet after diffusion of the present embodiment may be at a depth of at least 0.5 mm or a depth of 0.1 mm from the diffusion surface. It is preferable that the region in which the concentration of the diffused heavy rare earth element decreases in the sintered magnet after diffusion is present from the diffusion surface to a depth of at least 0.1 mm since the corrosion resistance is enhanced. Incidentally, the depth from the diffusion surface is the distance measured from the diffusion surface to the inside of the magnet after diffusion in the normal direction of the diffusion surface.

The diffused heavy rare earth element may include a heavy rare earth element other than Tb or Dy together with Tb or Dy. The heavy rare earth element other than Tb or Dy may be at least one kind selected from the group consisting of Gd, Ho, Er, Tm, Yb, and Lu. The content of Tb or Dy introduced into the sintered magnet by diffusion is preferably from 0.1 to 1 mass % and more preferably from 0.2 to 0.7 mass %. In addition, the content of the heavy rare earth element other than Tb or Dy introduced into the sintered magnet by diffusion is more preferably 0.1 mass % or less. Incidentally, the sintered magnet after diffusion may contain a heavy rare earth element derived from the sintered magnet before diffusion, but the diffused heavy rare earth element is different from that derived from the sintered magnet before diffusion in that it has a region in which the concentration thereof decreases from the diffusion surface toward the inside of the magnet.

Figure 10:
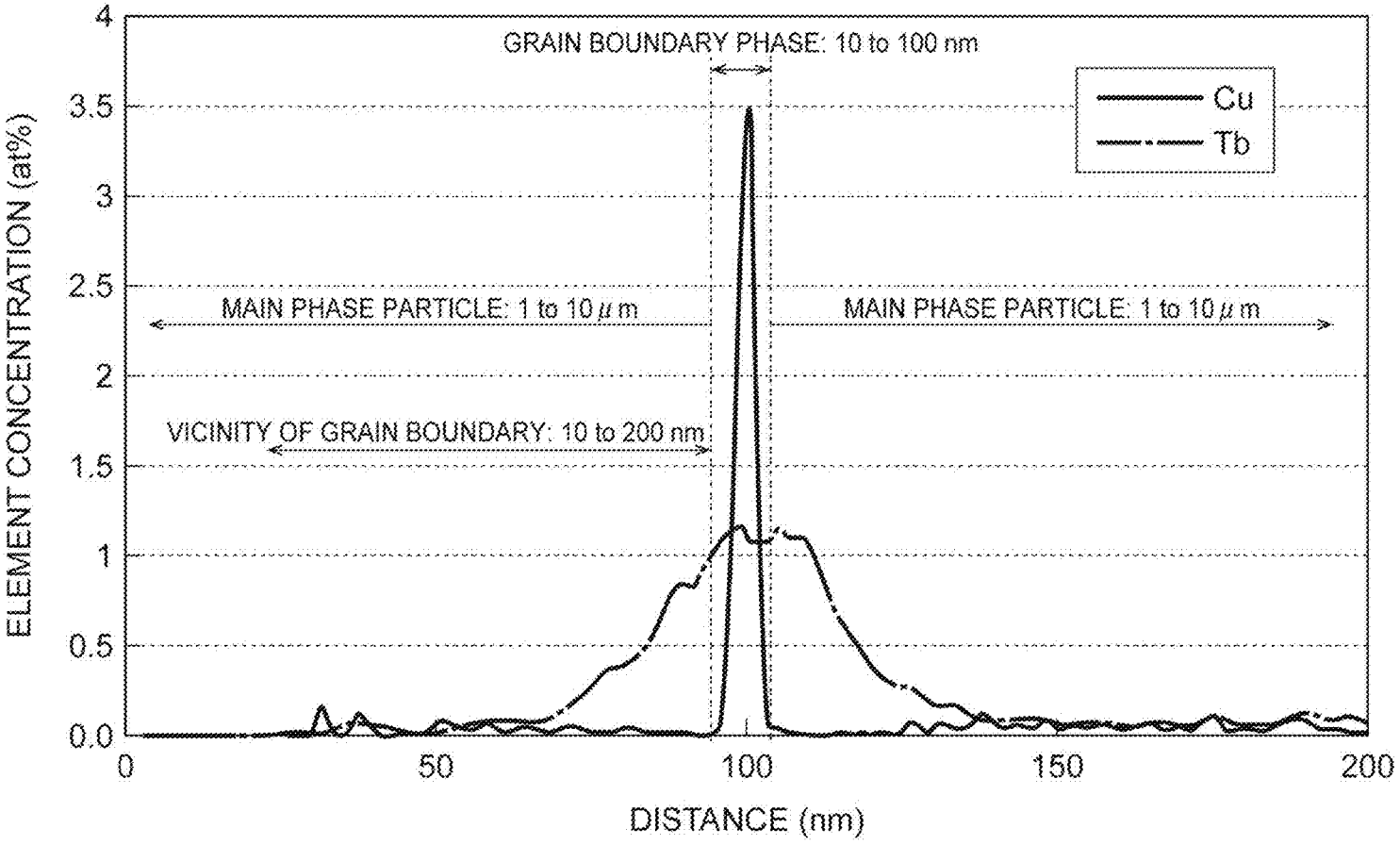
FIG. 10 illustrates the respective concentration distribution curves of Tb and Cu in the grain boundary phase between two main phase particles and the vicinity thereof in the sintered magnet after diffusion of Example 1.

The sintered magnet after diffusion of the present embodiment is equipped with the main phase particles and the grain boundary phase occupying the space among the main phase particles. The sintered magnet after diffusion of the present embodiment has a grain boundary phase containing at least either of Tb or Dy and Nd between two main phase particles, and the value obtained by subtracting the half value width of the concentration distribution curve of Cu from the half value width of the concentration distribution curve of Tb or Dy in a part including the grain boundary phase is from 10 to 20 nm. Here, the part including the grain boundary phase is composed of the grain boundary phase between two main phase particles and the region in the vicinity of the grain boundary phase in the main phase particles. The respective concentration distribution curves of Tb and Cu in the grain boundary phase between two main phase particles and the vicinity of the grain boundary phase in the sintered magnet after diffusion of Example 1 to be described later are illustrated in FIG. 10 as an example. In the sintered magnet after diffusion of the present embodiment as well, Cu is only present in the grain boundary phase between two main phase particles so that the concentration distribution curve of Cu has a sharp distribution between two main phase particles. Meanwhile, as illustrated in FIG. 10, the diffused heavy rare earth element is distributed not only in the grain boundary phase between two main phase particles but also in the vicinity of the grain boundary phase (region from the surface of the main phase particles in contact with the grain boundary phase between two main phase particles to about from 10 to 200 nm or about from 10 to 100 nm in the main phase particles). The concentration distribution curve can be determined by measuring the concentration along the line segment representing the distance (may be the shortest distance) from an arbitrary point on the surface of one main phase particle to the surface of the other main phase particle so as to cross the grain boundary phase between the two main phase particles and the vicinity of the grain boundary phase in one cross section of the sintered magnet after diffusion by 3DAP or the like. The region of the concentration distribution curve to be measured is not particularly limited as long as the half value width of the concentration distribution curve of Tb or Dy and the half value width of the concentration distribution curve of Cu are determined, but it may be about 200 nm. Here, the cross section may be a surface perpendicular to the diffusion surface. In addition, the half value width indicates the full width at half maximum. The definition of the grain boundary phase between two main phase particles in the sintered magnet after diffusion is the same as that defined in the sintered magnet before diffusion.

Cu does not dissolve in the main phase particles to form a solid solution but is present in the grain boundary phase so as to indicate the grain boundary phase of the magnet. Hence, the value obtained by subtracting the half value width of the concentration distribution curve of Cu from the half value width of the concentration distribution curve of Tb or Dy in the grain boundary phase between two main phase particles and the vicinity thereof indicates the diffusion range of the heavy rare earth element into the main phase particles.

Such a sintered magnet after diffusion exhibits excellent rectangularity in the magnetization curve. Incidentally, for the evaluation of rectangularity, for example, it is possible to use a value obtained by dividing the magnetic field Ilk when the magnetic flux density decreases by 10% from the residual magnetic flux density by HcJ in the magnetization curve.

The reason for that the sintered magnet after diffusion according to the present embodiment exhibits excellent rectangularity is not necessarily clearly known, but the present inventors believe that this is because the presence proportion of particles having a low coercive force decreases as the diffusion of a heavy rare earth element uniformly proceeds so that the distribution of the coercive force for each grain is small and the diffusion of the heavy rare earth element into the main phase particles is controlled, and the variation thereof is small as a result. Incidentally, the half value width of the concentration distribution curve is obtained by performing curve fitting of the concentration distribution curve measured by the above method with a Gaussian function. The difference in half value width is from 10 to 20 nm and more preferably from 15 to 19 nm.

The sintered magnet after diffusion of the present embodiment may be a core-shell type sintered magnet. The core-shell type sintered magnet is equipped with a plurality of main phase particles equipped with a core and a shell covering the core. In the shell, the proportion (heavy rare earth element/light rare earth element) of the heavy rare earth element to the light rare earth element in the main phase particles is higher than the proportion in the core, and for example, the part at which the proportion in the shell is two times or more the proportion in the core is regarded as the shell. The concentration of heavy rare earth element in the shell is preferably from 0.5 to 7 mass % from the viewpoint of cost reduction due to a decrease in amount of heavy rare earth element and improvement of the coercive force.

<Method for Producing Alloy for Magnet>

Hereinafter, a method for producing the alloy for magnet of the present embodiment will be described.

First, raw materials containing Nd, Fe, Co, Cu, and B are prepared. Examples of the raw materials containing Nd, Fe, Co, and Cu may include metals of Nd, Fe, Co, and Cu or alloys thereof. B is added in the form of a compound with a metal, and examples thereof may include Fe—B. In a case in which the desired alloy for magnet contains metals other than Nd, Fe, Co, and Cu, these metals can be added to the raw material powders as a simple substance or an alloy.

The raw material powders are weighed so as to have the composition of the desired magnet alloy and mixed together. The mixture of the raw material powders thus obtained is put in a heat-resistant container such as an alumina crucible and melted in a furnace such as a high-frequency vacuum induction furnace to obtain a molten metal. It is required to once raise the temperature of the molten metal to the casting temperature or higher so as to eliminate the unmelted residue (melting maximum temperature). A high temperature is favorable in order to eliminate the unmelted residue, but the amount of impurities increases and the magnetic properties are adversely affected when the temperature is too high. The close contact of the molten metal with the mold or the roll is improved and the cooling speed increases when the casting temperature is high. The atmosphere in the furnace is preferably an inert atmosphere such as Ar. Examples of the method for obtaining an alloy for magnet from the molten metal thus obtained may include a strip casting method, a centrifugal casting method, and a book molding method, but a strip casting method is desirable from the viewpoint of texture control. The strip casting method is a method to cool the molten alloy on a roll. The material of the roll is preferably Cu or a Cu alloy from the viewpoint of thermal conductivity. In particular, Be—Cu, Cr—Cu, and the like are particularly preferable since they also have strength. As the surface state of the roll, the surface is likely to repel the molten metal when the roughness thereof is coarse but the surface does not come into close contact with the molten metal when the roughness thereof is fine. Examples of the method for controlling the surface state of the roll may include a method to polish the surface of the roll with sandpaper or the like. Examples of a preferable number of sandpaper may include from #100 to #1200. In addition, the direction of polishing is not particularly limited, and it may be polished in the circumferential direction of the roll, in a direction perpendicular to the circumferential direction of the roll (direction along the axis of the roll), or obliquely in other directions, but it is preferable to obliquely polish. It is required to adjust the direction of polishing each time depending on the composition and casting conditions since it depends on the composition, temperature, viscosity, surface tension, and the like of the molten metal. The rotational speed (circumferential speed) of the roll is preferably from 1 to 10 m/s. It is difficult for the molten metal to come into close contact with the roll and it is impossible to take time for cooling when the rotational speed of the roll is too fast. Meanwhile, the cast slab is likely to be thick when the rotational speed of the roll is slow. In addition, it is possible to change the cooling speed by changing other conditions such that the surface of the roll is roughened so as to make it easier to bring the alloy into close contact with the roll, for example, in a case in which the rotational speed of the roll is fast. The temperature of the alloy after cooling on the roll is the temperature close to the melting point of the R-rich phase, and the subsequent temperature history thus also affects the texture in some cases (secondary cooling). The textural structure of the R-rich phase is less likely to be broken when the cooling speed is raised by spraying with Ar or water cooling of the recovery container in the secondary cooling.

When obtaining an alloy for magnet, for example, it is preferable to receive a molten alloy with a tundish for controlling the amount of molten metal and then to cool it on a roll to fabricate a cast in the strip casting method. By such a method, the main phase crystal grows from the roll surface in the thickness direction of the alloy and an R-rich phase is generated between a main phase crystal and another main phase crystal. The melting maximum temperature is preferably higher than the melting point of the alloy for magnet by from 200 to 350° C. It is preferable that the temperature (casting temperature) of the molten metal immediately before the roll when pouring the molten metal from the tundish onto the roll is higher than the melting point of the alloy for magnet by from 200 to 250° C. Incidentally, the temperature when pouring the molten alloy from the crucible into the tundish may be appropriately determined according to the casting temperature. It is preferable that the temperature of the alloy immediately after being peeled off from the roll is from 400 to 650° C. For example, by such a method, it is possible to easily obtain an alloy for magnet having the degree of coincidence of Nd—Cu of 80% or more. The thickness of the alloy is, for example, preferably from 50 to 500 μm, more preferably from 100 to 400 μm, and even more preferably from 200 to 300 μm. The distance between an R-rich phase and another R-rich phase is preferably from 1 to 10 μm, more preferably from 2 to 6 μm, and even more preferably from 3 to 5 μm.

<Method for Producing Sintered Magnet Before Diffusion>

The sintered magnet before diffusion of the present embodiment is obtained by using the alloy for magnet of the present embodiment as a raw material alloy. Incidentally, as the raw material alloy, the alloy for magnet of the present embodiment can be used singly from the viewpoint of cost reduction, but an alloy other than the alloy for magnet of the present embodiment may be used concurrently. Examples of the alloy other than the alloy for magnet of the present embodiment may include an R-T alloy and an R-T-B alloy which contain a rare earth element R, and in particular, an R-T alloy composed of a rare earth element and a transition metal element is preferable. Specific examples of the R-T alloy may include an R—Fe—Al alloy, an R—Fe—Al—Cu alloy, and an R—Fe—Al—Cu—Co—Zr alloy. The amount of the alloy for magnet of the present embodiment used is set to preferably 80 mass % or more and more preferably 90 mass % or more based on the total mass of the alloys to be used in the case of using a plurality of alloys as the raw material.

First, the alloy for magnet is coarsely crushed into particles having a particle diameter of about several hundred μm. For coarse crushing of the alloy for magnet, for example, a coarse crusher such as a jaw crusher, a brown mill, or a stamp mill may be used. In addition, it is preferable to conduct the coarse crushing of the alloy for magnet in an inert gas atmosphere. The alloy for magnet may be subjected to hydrogen storage crushing. In the hydrogen storage crushing, it is possible to coarsely crush the alloy for magnet through self-collapse based on the difference in hydrogen storage capacity between different phases by storing hydrogen in the alloy for magnet and then heating the alloy for magnet in an inert gas atmosphere.

The coarsely crushed alloy for magnet may be finely crushed until the particle diameter thereof reaches 1 to 10 μm. For fine crushing, a jet mill, a ball mill, a vibration mill, a wet attritor, or the like may be used. For fine crushing, additives such as zinc stearate and oleic acid amide may be added to the raw material alloy. This makes it possible to improve the orientation of the alloy for magnet at the time of molding.

The crushed alloy for magnet is subjected to pressure molding in a magnetic field to be formed into a molded body. The magnetic field at the time of pressure molding may be about from 950 to 1600 kA/m. The pressure at the time of pressure molding may be about from 50 to 200 MPa. The shape of the molded body is not particularly limited, and it may be a columnar shape, a tabular shape, a ring shape, and the like.

The molded body is sintered in a vacuum or an inert gas atmosphere to obtain a sintered magnet before diffusion. The sintering temperature may be adjusted according to various conditions such as the composition of the raw material alloy, the crushing method, the particle size, and the particle size distribution. The sintering temperature may be from 900 to 1100° C., and the sintering time may be about from 1 to 10 hours. The aging treatment may be conducted after sintering. The coercive force as a sintered magnet before diffusion is greatly improved by the aging treatment. In the case of conducting the diffusion treatment, the diffusion treatment is not affected by the aging treatment since the temperature for diffusion heat treatment is higher than the temperature for aging treatment.

The content of oxygen in the sintered magnet before diffusion is preferably 3000 mass ppm or less, more preferably 2500 mass ppm or less, and even more preferably 1000 mass ppm or less. The impurities in the sintered magnet to be obtained decrease and the magnetic properties of the sintered magnet are improved as the amount of oxygen is smaller. In a case in which the amount of oxygen is great, the oxide in the sintered body prevents diffusion of the heavy rare earth element and the heavy rare earth element is thus likely to segregate in the multiparticle grain boundary phase in the diffusion step to be described later. Hence, the shell is hardly formed and the coercive force tends to decrease. Examples of the method for decreasing the content of oxygen in the sintered body may include a method to maintain the raw material alloy in an atmosphere having a low oxygen concentration during the period from hydrogen storage crushing to sintering.

The surface of the sintered magnet before diffusion may be treated with an acid solution after the sintered magnet before diffusion is processed into a desired shape. As the acid solution to be used in the surface treatment, a mixed solution of an aqueous solution of nitric acid, hydrochloric acid, or the like with an alcohol is suitable. Examples of the method for surface treatment may include immersion of the sintered magnet before diffusion in an acid solution and spraying of an acid solution to the sintered body. By the surface treatment, it is possible to obtain a clean surface as the contaminants, an oxidized layer, and the like which are attached to the sintered magnet before diffusion are removed and it is possible to reliably conduct the attachment and diffusion of Tb or Dy compound particles to be described later. The surface treatment may be conducted while applying ultrasonic waves to the acid solution from the viewpoint of further improving removal of the contaminants, an oxidized layer, and the like.

<Method for Producing Sintered Magnet after Diffusion>

The sintered magnet after diffusion of the present embodiment can be obtained by diffusing a heavy rare earth element into the sintered magnet before diffusion described above (diffusion step). In the present embodiment, the heavy rare earth element includes Tb or Dy.

First, a heavy rare earth compound containing a heavy rare earth element is attached to the surface of the sintered magnet before diffusion. Examples of the heavy rare earth compound may include an alloy, an oxide, a halide, a hydroxide, and a hydride, but it is preferable to use a hydride in particular. In the case of using a hydride, only the element Tb or Dy contained in the hydride diffuses into the magnet body when diffusing the heavy rare earth element. Hydrogen contained in the hydride is released to the outside of the sintered magnet before diffusion when diffusing the heavy rare earth element. Hence, impurities derived from the heavy rare earth element compound do not remain in the sintered magnet after diffusion to be finally obtained when a hydride of a heavy rare earth element is used, and a decrease in residual magnetic flux density of the sintered magnet after diffusion is thus likely to be prevented. Examples of the hydride of a heavy rare earth element may include $DyH_2$, $TbH_2$, or a hydride of Dy—Fe or Tb—Fe. In particular, $DyH_2$ or $TbH_2$ is preferable. In the case of using a hydride of Dy—Fe, Fe also tends to diffuse into the sintered magnet after diffusion in the heat treatment step.

The heavy rare earth compound to be attached to the sintered magnet before diffusion is preferably in the form of particles, and the average particle diameter thereof is preferably from 100 nm to 50 μm and more preferably from 1 μm to 10 μm. The amount of the heavy rare earth compound to diffuse into the sintered magnet before diffusion is not too great and a decrease in residual magnetic flux density of the sintered magnet after diffusion can be suppressed when the particle diameter of the heavy rare earth compound is 100 nm or more. The heavy rare earth compound is likely to diffuse into the sintered magnet before diffusion and the coercive force can be improved when the particle diameter is 50 μm or less.

Examples of the method for attaching the heavy rare earth compound to the sintered magnet before diffusion may include a method to blow particles of the heavy rare earth compound to the sintered magnet before diffusion as they are, a method to coat the sintered magnet before diffusion with a solution prepared by dissolving the heavy rare earth compound in a solvent, a method to coat the sintered magnet before diffusion with a slurry diffusing agent prepared by dispersing particles of the heavy rare earth compound in a solvent, a method to deposit the heavy rare earth element onto the sintered magnet before diffusion, and a method to electrodeposit the heavy rare earth element onto the sintered magnet before diffusion. Among them, a method to coat the sintered magnet before diffusion with a diffusing agent is preferable. In the case of using a diffusing agent, the heavy rare earth compound can be uniformly attached to the sintered magnet before diffusion and the diffusion of the heavy rare earth element can reliably proceed. Hereinafter, the case of using a diffusing agent will be described.

As a solvent to be used in the diffusing agent, it is preferable to use a solvent capable of uniformly dispersing the heavy rare earth compound without dissolving it. Examples of the solvent may include an alcohol, an aldehyde, and a ketone, and ethanol is preferable among them. The sintered body may be immersed in the diffusing agent, or the diffusing agent may be dropped on the sintered magnet before diffusion.

In the case of using a diffusing agent, the content of the heavy rare earth compound in the diffusing agent may be appropriately adjusted according to the target value of the mass concentration of the heavy rare earth element in the sintered magnet before diffusion. For example, the content of the heavy rare earth compound in the diffusing agent may be from 10 to 90 mass % or from 60 to 80 mass %. The heavy rare earth compound tends to be hardly uniformly attached to the sintered body when the content of the heavy rare earth compound in the diffusing agent is out of these numerical ranges. In addition, in a case in which the content of the heavy rare earth compound in the diffusing agent is too great, the surface of the sintered body is roughened so that it is difficult to form plating or the like for improving the corrosion resistance of the magnet to be obtained in some cases. However, the effect described above is achieved even if the content of the heavy rare earth compound in the diffusing agent is out of the above range.

The temperature for heat treatment for diffusing the heavy rare earth element is preferably from 700 to 950° C. The time for heat treatment is preferably from 5 to 50 hours. By such a heat treatment, the heavy rare earth diffuses into the sintered magnet before diffusion and the sintered magnet of the present embodiment is thus obtained.

The heavy rare earth element diffuses from the surface of the sintered magnet before diffusion to the inside of the magnet through the grain boundary phase and slightly diffuses to the surface of the main phase particles. Accordingly, the concentration of the heavy rare earth element tends to decrease from the surface to the inside in the sintered magnet after diffusion unlike the sintered magnet before diffusion. In addition, the coercive force tends to be higher as it is closer to the surface.

The sintered magnet thus obtained may be subjected to the aging treatment. The aging treatment contributes to the improvement of the magnetic properties (especially the coercive force) of the sintered magnet. The aging temperature is preferably from 450 to 600° C. The aging time is preferably from 0.5 to 5 hours. A plating layer, an oxide layer, a resin layer, or the like may be formed on the surface of the sintered magnet after diffusion. These layers function as a protective layer for preventing deterioration of the magnet.

The sintered magnet after diffusion of the present embodiment can be used in, for example, a motor, a linear motor, and a magnetic field generator.

EXAMPLES

<Fabrication of Alloy for Magnet>

Raw materials containing the respective elements were weighed so as to have the composition presented in Table 1 and mixed together. Incidentally, as the raw materials containing the respective elements, pure iron (purity: 99.9 mass %), Fe—B (B: 21 mass %), Nd (purity: 99.9 mass %), Pr (purity: 99.9 mass %), Dy—Fe (Dy: 80 mass %), Al (purity: 99.9 mass %), Co (purity: 99.9 mass %), Cu (purity: 99.9 mass %), Fe—Zr mass %), and Ga (purity: 99.9 mass %) were used. The raw material mixture was put in an alumina crucible and heated in a high-frequency vacuum induction furnace to obtain a molten metal. Alloys for magnet of alloys 1 to 7 and comparative alloys 1 to 6 were obtained by subjecting the molten metal thus obtained to strip casting. Here, a roll of which the surface was polished with sandpaper in advance was used in the strip casting. The material of the roll, the number of sandpaper, and polishing direction (surface state of the roll) used when fabricating the alloys for magnet of alloys 1 to 7 and comparative alloys 1 to 6 are presented in Table 2. In addition, in the strip casting, the maximum temperature of the molten metal (melting maximum temperature) before being poured onto the roll, the temperature of the molten metal immediately before the roll when pouring the molten metal onto the roll (casting temperature) were measured with a thermocouple and the temperature of the alloy immediately after being peeled off from the roll (alloy cooling temperature) was measured with a thermograph. The melting maximum temperature, casting temperature, and alloy cooling temperature when fabricating the respective alloys for magnet are presented in Table 2. Furthermore, the circumferential speed of the roll in the strip casting, the atmosphere in the chamber during casting, and the cooling method for the alloy peeled off from the roll are also presented in Table 2.

For each of the alloys 1 to 7 and comparative alloys 1 to 6, the alloy cross section was subjected to the elemental analysis by EPMA. The area was calculated from the compositional profile (CP) thus obtained by image recognition of the R-rich phase to obtain the area of the R-rich phase. Next, the number of pixels contained in the region (region A) in which the element concentration of Cu was 0.5 at % or more in the R-rich phase was counted and the area of the region A was calculated by multiplying the number of pixels by the area of one pixel (0.2 μm×0.2 μm). In addition, the number of pixels in the region (region B) in which the element concentration of Co was 2.5 at % or more in the region A was counted and the area of the region B was calculated by multiplying the number of pixels by the area of one pixel in the same manner. The degree of coincidence of Nd—Cu and the degree of coincidence of Nd—Cu—Co were determined from the areas of region A and region B thus obtained. The results thereof are presented in Table 3. Incidentally, the alloy 4 and the comparative alloy 3 had the same composition and production conditions as the alloy 1 and the comparative alloy 1, respectively, and the measurement of degree of coincidence of Nd—Cu (area of region A/area of R-rich phase) and degree of coincidence of Nd—Cu—Co (area of region B/area of region A) was thus omitted.

<Fabrication of Sintered Magnet Before Diffusion>

The respective alloys 1 to 7 and comparative alloys 1 to 6 were subjected to hydrogen storage and then heated to 600° C. to obtain coarse powders. Oleic acid amide was added to the coarse powder thus obtained at 0.1 mass % and mixed by using a mixer. After mixing, the mixture was crushed by using a jet mill to obtain an alloy powder. The alloy powder thus obtained was molded in a magnetic field of 3 T to obtain a molded body. The molded body was calcined at 1080° C. in a vacuum atmosphere for 4 hours to obtain a sintered magnet before diffusion. Incidentally, the sintered magnets before diffusion thus obtained are respectively referred to as sintered magnets 1A to 7A and comparative sintered magnets 1A to 6A so as to correspond to the alloys 1 to 7 and comparative alloys 1 to 6 of the raw materials. The sintered magnets 1A to 7A and comparative sintered magnets 1A to 6A were subjected to the measurement of residual magnetic flux density (Br), coercive force (HcJ), and rectangularity (Hk/HcJ) by a BH tracer. The results thereof are presented in Table 4. In addition, sintered magnets 1 B to 7 B and comparative sintered magnets 1 B to 6 B were respectively fabricated in the same manner as the sintered magnets 1 A to 7 A and the comparative sintered magnets 1 A to 6 A except that the sintering time was set to 12 hours and subjected to the measurement of residual magnetic flux density (Br), coercive force (HcJ), and rectangularity (Hk/HcJ) by a BH tracer. The results thereof are presented in Table 5.

Incidentally, the sintered magnet 4A and the comparative sintered magnet 3A had the same composition and production conditions as the sintered magnet 1A and the comparative sintered magnet 1A, respectively, and the measurement of residual magnetic flux density and the like was thus omitted. The same applies to the sintered magnet 4B and the comparative sintered magnet 3B.

For the sintered magnets 1A to 7A and the comparative sintered magnets 1A to 6A, the element concentration of Cu was measured by 3DAP. The maximum value of the element concentration of Cu in the grain boundary phase between two main phase particles measured was taken as the maximum element concentration of Cu. The results thereof are presented in Table 4. For the sintered magnets 1 B to 7 B and the comparative sintered magnets 1 B to 6 B as well, the maximum element concentration of Cu was measured in the same manner. The results thereof are presented in Table 5.

<Fabrication of Sintered Magnet after Diffusion>

The heavy rare earth elements presented in Table 6 were diffused into the sintered magnets 1A to 7A and the comparative sintered magnets 1A to 6A to obtain sintered magnets after diffusion of Examples 1 to 7 and Comparative Examples 1 to 6. As the diffusion method, Tb or Dy was attached to the surface of the sintered magnet at 1 mass % and the sintered magnet was then subjected to the diffusion treatment at 900° C. for 12 hours. Thereafter, the sintered magnet was subjected to the aging treatment at 500° C. for 1 hour to obtain a sintered magnet after diffusion. The respective sintered magnets after diffusion were subjected to the measurement of residual magnetic flux density (Br), coercive force (HcJ), and rectangularity (Hk/HcJ) by a BH tracer. In addition, the respective sintered magnets after diffusion were subjected to the measurement of concentration distribution curves of Tb or Dy and Cu between two main phase particles by 3DAP. The concentration distribution curves thus obtained were subjected to the Gaussian fitting to calculate the half value width, and the difference between the half value width of the concentration distribution curve of Tb or Dy and the half value width of the concentration distribution curve of Cu was determined. The results thereof are presented in Table 6.

TABLE 1

| | Nd mass % | Pr mass % | Dy mass % | B mass % | Al mass % | Co mass % | Cu mass % | Zr mass % | Ga mass % | Fe mass % |
|---|---|---|---|---|---|---|---|---|---|---|
| Alloy 1 | 23 | 8 | 0 | 0.95 | 0.2 | 2 | 0.2 | 0.2 | 0.2 | Remainder |
| Alloy 2 | 23 | 8 | 0 | 0.95 | 0.2 | 2 | 0.2 | 0.2 | 0.2 | Remainder |
| Alloy 3 | 23 | 8 | 0 | 0.95 | 0.2 | 2 | 0.2 | 0.2 | 0.2 | Remainder |
| Comparative alloy 1 | 23 | 8 | 0 | 0.95 | 0.2 | 2 | 0.2 | 0.2 | 0.2 | Remainder |
| Comparative alloy 2 | 23 | 8 | 0 | 0.95 | 0.2 | 2 | 0.2 | 0.2 | 0.2 | Remainder |
| Alloy 4 | 23 | 8 | 0 | 0.95 | 0.2 | 2 | 0.2 | 0.2 | 0.2 | Remainder |
| Comparative alloy 3 | 23 | 8 | 0 | 0.95 | 0.2 | 2 | 0.2 | 0.2 | 0.2 | Remainder |
| Alloy 5 | 21 | 7 | 1.8 | 0.95 | 0.2 | 2 | 0.2 | 0.2 | 0.2 | Remainder |
| Comparative alloy 4 | 21 | 7 | 1.8 | 0.95 | 0.2 | 2 | 0.2 | 0.2 | 0.2 | Remainder |
| Alloy 6 | 23 | 8 | 0 | 0.95 | 0.23 | 2 | 0.2 | 0 | 0.2 | Remainder |
| Comparative alloy 5 | 23 | 8 | 0 | 0.95 | 0.23 | 2 | 0.2 | 0 | 0.2 | Remainder |
| Alloy 7 | 23 | 8 | 0 | 0.95 | 0.18 | 2 | 0.2 | 0.2 | 0 | Remainder |
| Comparative alloy 6 | 23 | 8 | 0 | 0.95 | 0.18 | 2 | 0.2 | 0.2 | 0 | Remainder |

TABLE 2

| | Melting maximum temperature Tm: melting point | Casting temperature | Alloy cooling temperature | Material of roll | Surface state of roll | Circumferential speed of roll | Atmosphere | Cooling method after being peeled off from roll |
|---|---|---|---|---|---|---|---|---|
| Alloys 1, 4, 5, 6 and 7 | Tm + 300° C. | Tm + 200° C. | 500° C. | Be—Cu alloy | Obliquely polished with #800 | 3 m/s | 90 kPa Ar | Blowing Ar gas |
| Alloy 2 | Tm + 250° C. | Tm + 180° C. | 600° C. | Cr—Cu alloy | Polished in circumferential direction with #800 | 3 m/s | 70 kPa Ar | Blowing Ar gas |
| Alloy 3 | Tm + 250° C. | Tm + 200° C. | 590° C. | Cr—Cu alloy | Polished in perpendicular to circumferential direction with #1200 | 2.5 m/s | 90 kPa Ar | Blowing Ar gas |
| Comparative alloys 1, 3, 4, 5 and 6 | Tm + 250° C. | Tm + 200° C. | 700° C. | Cr—Cu alloy | Obliquely polished with #800 | 2.5 m/s | 90 kPa Ar | Blowing Ar gas |
| Comparative alloy 2 | Tm + 150° C. | Tm + 150° C. | 720° C. | Cr—Cu alloy | Polished in circumferential direction with #800 | 3 m/s | 90 kPa Ar | Standing to cool |

TABLE 3

| | Degree of coincidence of Nd—Cu (%) | Degree of coincidence of Nd—Cu—Co (%) |
|---|---|---|
| Alloy 1 | 98 | 82 |
| Alloy 2 | 93 | 79 |
| Alloy 3 | 81 | 63 |
| Comparative alloy 1 | 75 | 56 |
| Comparative alloy 2 | 63 | 46 |
| Alloy 4 | The same alloy as alloy 1 | |
| Comparative alloy 3 | The same alloy as comparative alloy 1 | |
| Alloy 5 | 95 | 81 |
| Comparative alloy 4 | 64 | 49 |
| Alloy 6 | 92 | 79 |
| Comparative alloy 5 | 56 | 41 |
| Alloy 7 | 97 | 84 |
| Comparative alloy 6 | 63 | 44 |

TABLE 4

| | Br mT | HcJ kA/m | Hk/HcJ % | Maximum element concentration of Cu in grain boundary between two particles (at %) |
|---|---|---|---|---|
| Sintered magnet 1A | 1428 | 1256 | 99.5 | 3.5 |
| Sintered magnet 2A | 1431 | 1230 | 99.5 | 3 |

TABLE 4-continued

| | Br mT | HcJ kA/m | Hk/HcJ % | Maximum element concentration of Cu in grain boundary between two particles (at %) |
|---|---|---|---|---|
| Sintered magnet 3A | 1429 | 1222 | 97.2 | 1.5 |
| Comparative sintered magnet 1A | 1426 | 1198 | 88.6 | 0.5 |
| Comparative sintered magnet 2A | 1418 | 1167 | 73.3 | 0.3 |
| Sintered magnet 4A | The same as sintered magnet 1A | | | |
| Comparative sintered magnet 3A | The same as comparative sintered magnet 1A | | | |
| Sintered magnet 5A | 1390 | 1415 | 99.3 | 3.3 |
| Comparative sintered magnet 4A | 1377 | 1369 | 86.2 | 0.4 |
| Sintered magnet 6A | 1431 | 1231 | 97.3 | 3.1 |
| Comparative sintered magnet 5A | 1428 | 1151 | 81.3 | 0.5 |
| Sintered magnet 7A | 1434 | 1172 | 99.4 | 3.4 |
| Comparative sintered magnet 6A | 1428 | 1101 | 87.4 | 0.8 |

TABLE 5

| | Br mT | HcJ kA/m | Hk/HcJ % | Maximum element concentration of Cu in grain boundary between two particles (at %) |
|---|---|---|---|---|
| Sintered magnet 1B | 1435 | 1250 | 99.5 | 3.5 |
| Sintered magnet 2B | 1432 | 1225 | 99.5 | 3 |
| Sintered magnet 3B | 1431 | 1218 | 99.1 | 2 |
| Comparative sintered magnet 1B | 1431 | 1198 | 99.1 | 0.9 |
| Comparative sintered magnet 2B | 1426 | 1158 | 95.6 | 0.7 |
| Sintered magnet 4B | The same as sintered magnet 1B | | | |
| Comparative sintered magnet 3B | The same as comparative sintered magnet 1B | | | |
| Sintered magnet 5B | 1387 | 1411 | 99.1 | 3.3 |
| Comparative sintered magnet 4B | 1373 | 1360 | 98.3 | 0.9 |
| Sintered magnet 6B | 1432 | 1201 | 97.1 | 3.1 |
| Comparative sintered magnet 5B | 1430 | 1161 | 93.8 | 0.6 |
| Sintered magnet 7B | 1441 | 1160 | 99.5 | 3.4 |
| Comparative sintered magnet 6B | 1434 | 1069 | 97.9 | 0.8 |

TABLE 6

| | Heavy rare earth element (content, mass %) | Difference in half value width nm | Br mT | HcJ kA/m | Hk/HcJ % |
|---|---|---|---|---|---|
| Example 1 | Tb (0.5) | 16 | 1430 | 1950 | 97.5 |
| Example 2 | Tb (0.5) | 17 | 1428 | 1919 | 97.2 |
| Example 3 | Tb (0.5) | 18 | 1426 | 1880 | 96.8 |
| Comparative Example 1 | Tb (0.5) | 22 | 1418 | 1786 | 94.2 |
| Comparative Example 2 | Tb (0.5) | 27 | 1410 | 1732 | 89.3 |
| Example 4 | Dy (0.4) | 17 | 1429 | 1597 | 97.3 |
| Comparative Example 3 | Dy (0.4) | 22 | 1416 | 1444 | 88.2 |
| Example 5 | Tb (0.5) | 17 | 1380 | 2149 | 97.3 |
| Comparative Example 4 | Tb (0.5) | 24 | 1362 | 1957 | 93.3 |
| Example 6 | Tb (0.5) | 18 | 1425 | 1889 | 97.1 |
| Comparative Example 5 | Tb (0.5) | 31 | 1411 | 1701 | 85.1 |
| Example 7 | Tb (0.5) | 16 | 1435 | 1850 | 97.1 |
| Comparative Example 6 | Tb (0.5) | 21 | 1428 | 1651 | 93.8 |

Figure 1B:
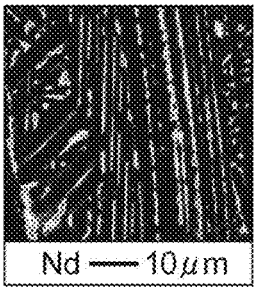
Figure 1C:
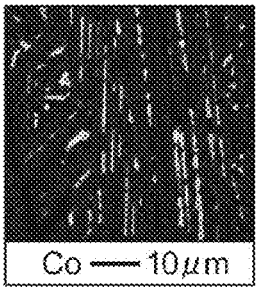
Figure 1D:
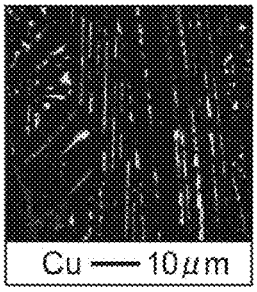
Figure 2A:
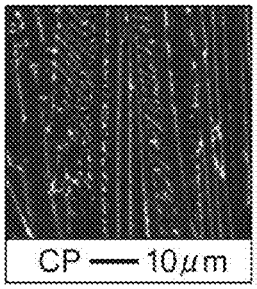
FIGS. 2A to 2D illustrate elemental analysis results of an alloy 2 by EPMA.
Figure 2B:
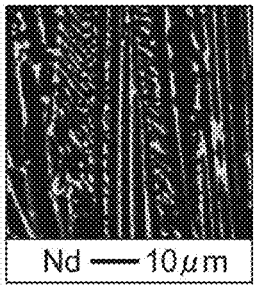
Figure 2C:
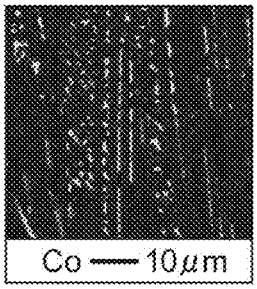
Figure 2D:
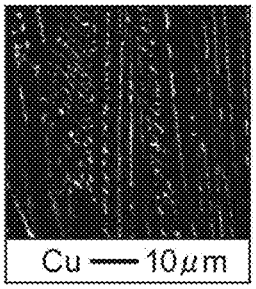
Figures 3A, 3B, 3C, 3D:
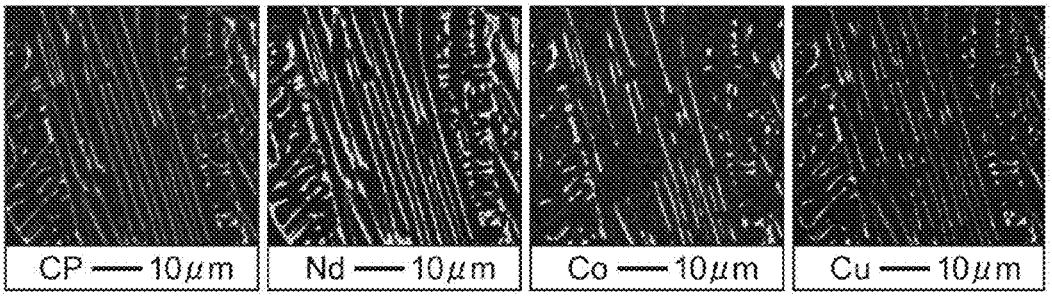
FIGS. 3A to 3D illustrate elemental analysis results of a comparative alloy 1 by EPMA.

The alloys 1 and 2 and the comparative alloy 1 were analyzed by EPMA. FIG. 1A illustrates the compositional profile of the alloy 1, and FIG. 1B to FIG. 1D illustrate the results on elemental analysis of Nd, Co, and Cu in the alloy 1, respectively. In FIG. 1A, the white part indicates an R-rich phase. In FIG. 1B to FIG. 1D, the white parts indicate the regions containing a great amount of corresponding elements. In the same manner, FIG. 2A to FIG. 2D illustrate the compositional profile of the alloy 2 and the results on elemental analysis of Nd, Co, and Cu in the alloy 2, respectively. FIG. 3A to FIG. 3D illustrate the compositional profile of the comparative alloy 1 and the results on elemental analysis of Nd, Co, and Cu in the comparative alloy 1, respectively.

Figure 4:
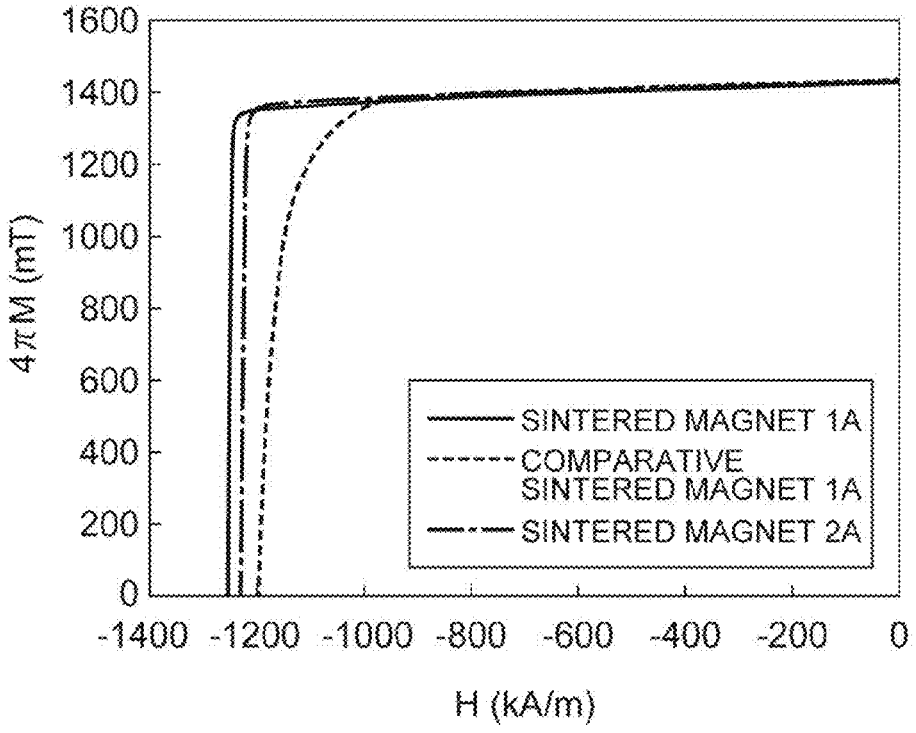
FIG. 4 illustrates magnetization curves of sintered magnets 1A and 2A and a comparative sintered magnet 1A.
Figure 5A:
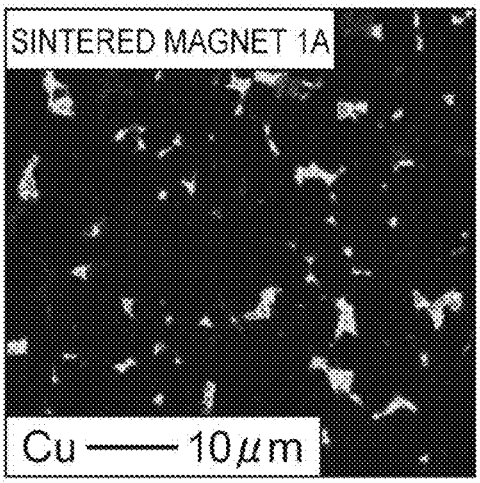
FIGS. 5A to 5C illustrate elemental analysis results of Cu in the sintered magnets 1A and 2A and the comparative sintered magnet 1A by EPMA.
Figure 5B:
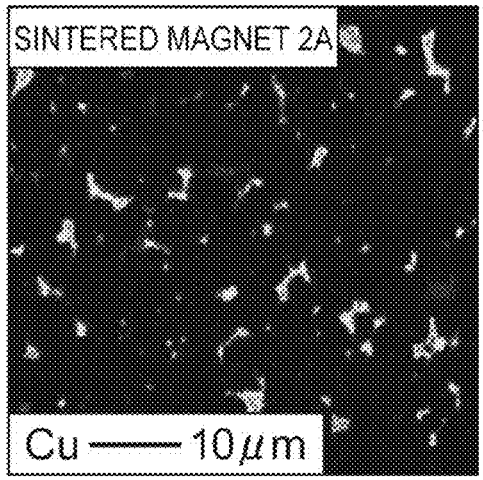
Figure 5C:
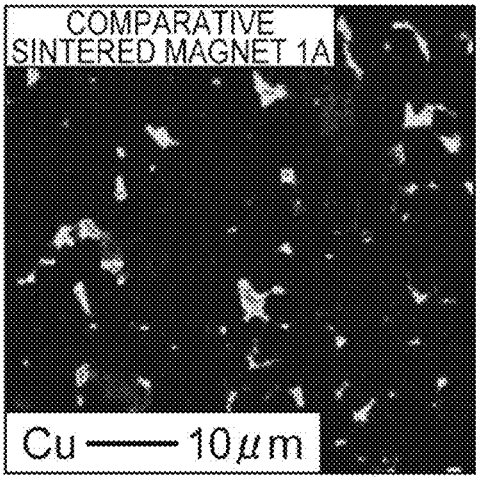

FIG. 4 illustrates the magnetization curves of the sintered magnets 1A and 2A and the comparative sintered magnet 1A, respectively. As illustrated in FIG. 4, the sintered magnets 1A and 2A exhibit superior rectangularity to the comparative sintered magnet 1A. In addition, FIGS. 5A to 5C illustrate the elemental analysis results of Cu in the sintered magnets 1A and 2A and the comparative sintered magnet 1A by EPMA, respectively. In FIGS. 5A to 5C, the white parts indicate the regions containing a great amount of Cu. It can be seen that Cu is present not only in the multiparticle grain boundary phase but also in the grain boundary phase between two main phase particles in the sintered magnets 1A and 2A.

Figure 6A:
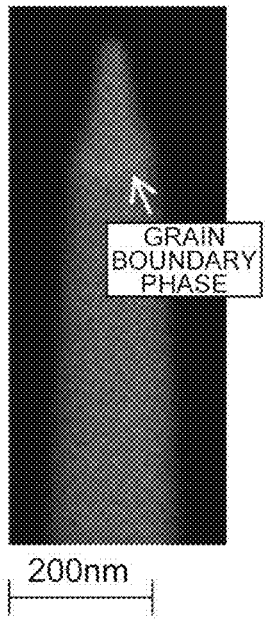
FIGS. 6A to 6C illustrate a 3DAP map of Nd in the sintered magnet 1A.
Figure 6B:
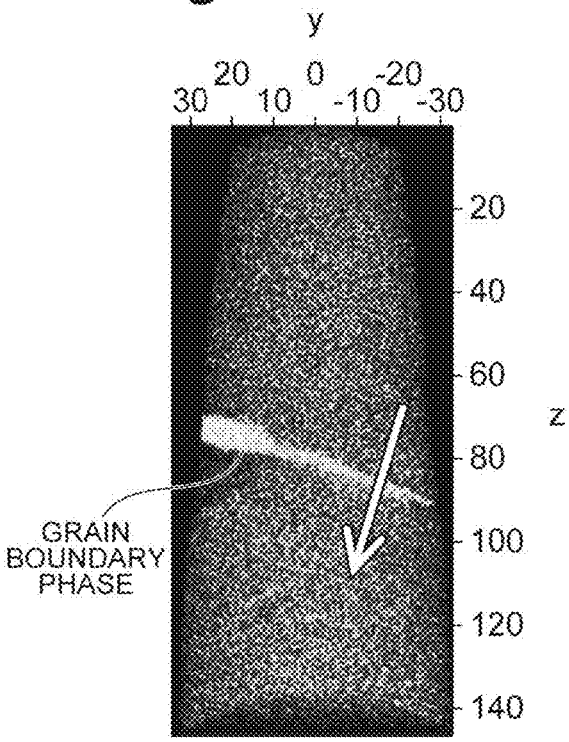
Figure 6C:
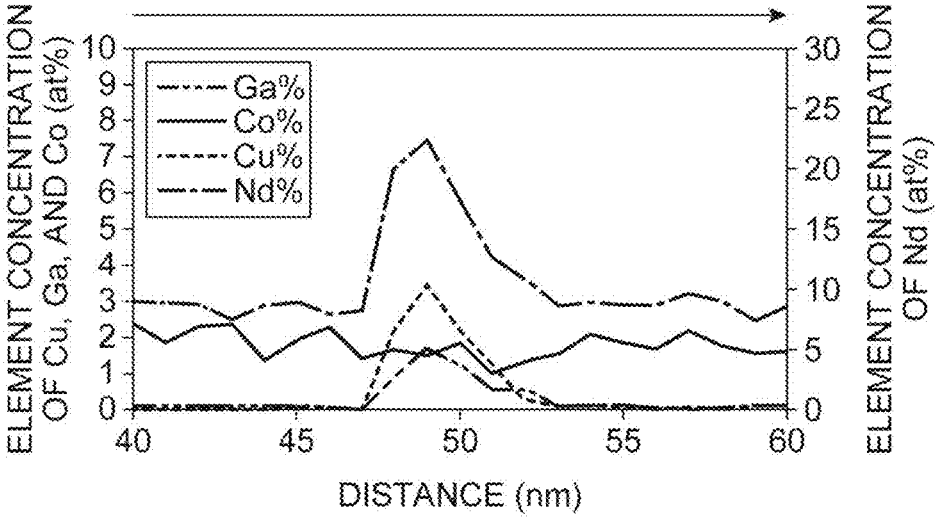
Figure 7A:
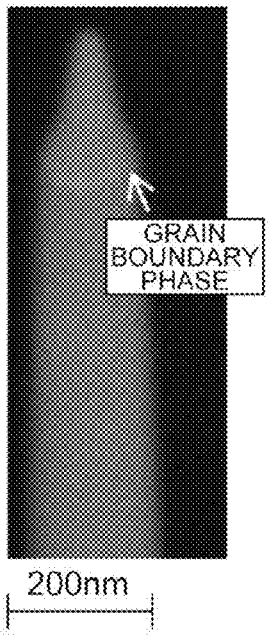
FIGS. 7A to 7C illustrate the 3DAP map of Nd in the comparative sintered magnet 1A.
Figure 7B:
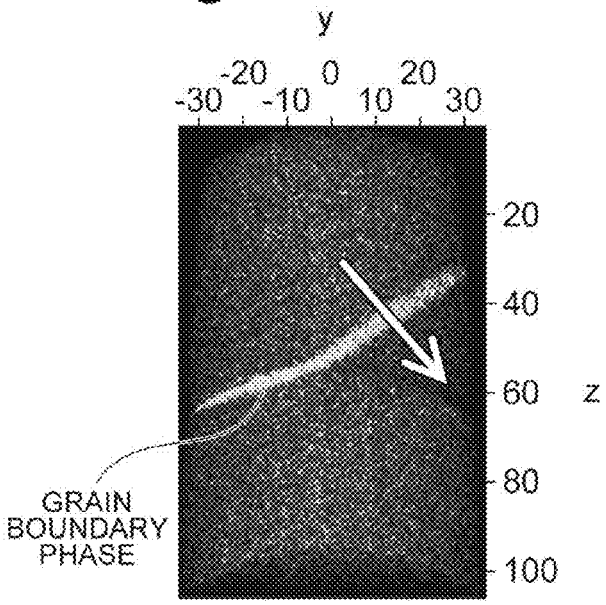
Figure 7C:
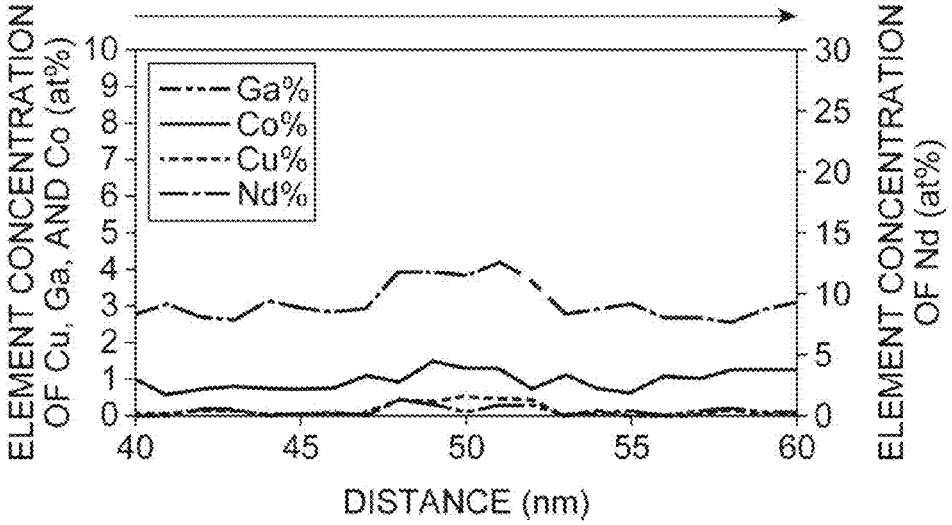

FIGS. 6A to 6C illustrate the 3DAP map of Nd in the sintered magnet 1A. In addition, FIGS. 7A to 7C illustrate the 3DAP map of Nd in the comparative sintered magnet 1A. FIG. 6B and FIG. 7B illustrate the enlarged views of the vicinity of the grain boundary phases in FIG. 6A and FIG. 7A, respectively. FIG. 6C and FIG. 7C illustrate the distribution of elements of Nd, Cu, Co, and Ga in the grain boundary phase between two main phase particles measured along the direction indicated by the arrows in FIG. 6B and FIG. 7B, respectively. As illustrated in FIG. 6C, it can be seen that Cu is most present in the grain boundary phase between two main phase particles in the sintered magnet 1A as the maximum values of the distribution of Nd and Cu substantially overlap and the maximum value of the element concentration of Cu is also 2 at % or more. On the other hand, as illustrated in FIG. 7C, the maximum value of the element concentration of Cu in the grain boundary phase between two main phase particles is less than 1 at % and the amount of Cu present in the grain boundary phase between two main phase particles is small in the comparative sintered magnet 1A.

Figure 8:
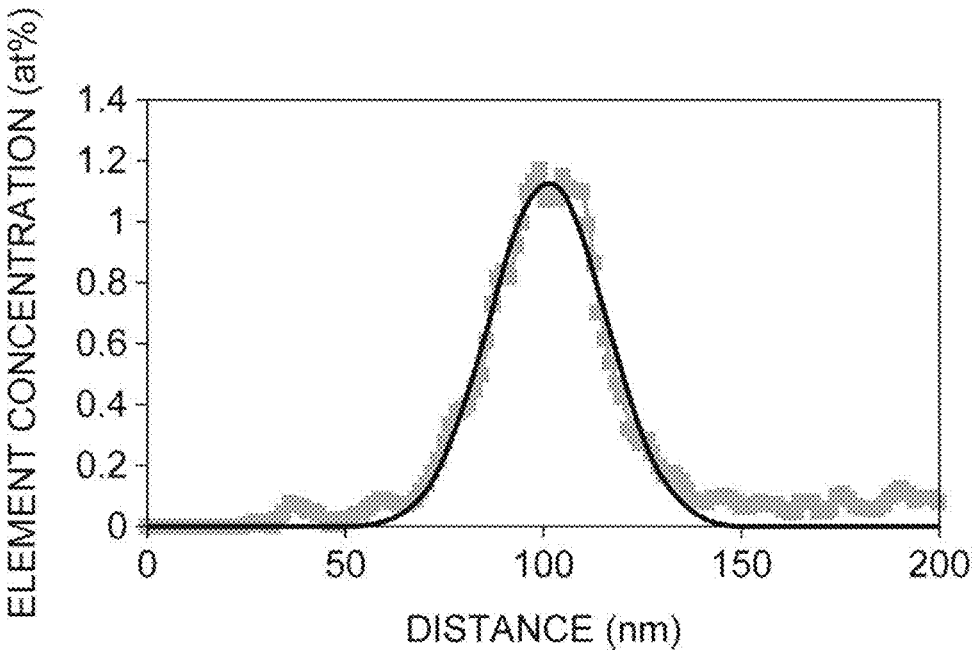
FIG. 8 illustrates the measurement result by 3DAP and Gaussian fitting result of element Tb between two main phase particles in the sintered magnet after diffusion of Example 1.
Figure 9:
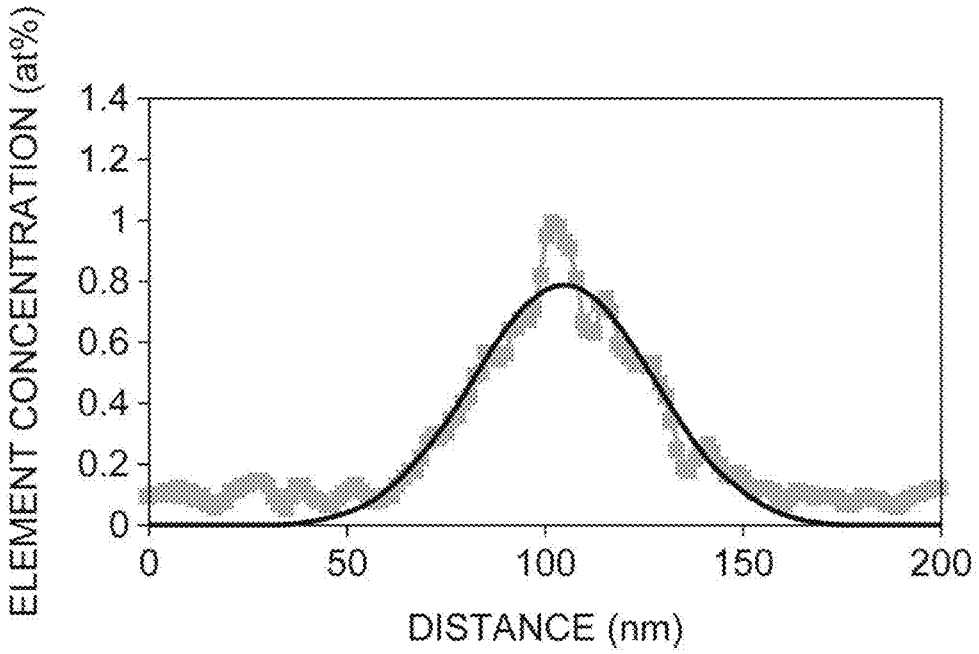
FIG. 9 illustrates the measurement result by 3DAP and Gaussian fitting result of element Tb between two main phase particles in the sintered magnet after diffusion of Comparative Example 1.

FIG. 8 and FIG. 9 illustrate the concentration distribution curves and Gaussian fitting results of element Tb between two main phase particles and in the vicinity thereof by 3DAP for Example 1 and Comparative Example 1, respectively. FIG. 10 illustrates the respective concentration distribution curves of Tb and Cu in the grain boundary phase between two main phase particles and the vicinity of the grain boundary phase in the sintered magnet after diffusion of Example 1.

What is claimed is:

1. A sintered magnet, wherein the sintered magnet is an R-T-B based sintered magnet having a region having a concentration of at least one heavy rare earth element decreasing from the surface toward the inside, wherein the at least one heavy rare earth element includes at least either of Tb or Dy, R includes Nd, T includes Fe, Co, and Cu, there is a grain boundary phase containing at least either of Tb or Dy and Nd between two main phase particles, and a value obtained by subtracting a half value width of a concentration distribution curve of Cu from a half value width of a concentration distribution curve of Tb or Dy in a part including the grain boundary phase is from 10 to 20 nm.

* * * * *